United States Patent [19]

Loveless et al.

[11] 4,122,021

[45] Oct. 24, 1978

[54] ANTIOXIDANT STABILIZED LUBRICATING OILS

[75] Inventors: Frederick Charles Loveless, Cheshire; Walter Nudenberg, Newtown, both of Conn.

[73] Assignee: Uniroyal, Inc., New York, N.Y.

[21] Appl. No.: 796,957

[22] Filed: May 16, 1977

[51] Int. Cl.[2] ..... 252 50; C10M 3/02; C10M 1/38; C10M 3/32

[52] U.S. Cl. ..... 252/26; 252/47.5; 252/48.2; 252/400 R; 252/402; C10M/1/10

[58] Field of Search ..... 252/26, 47.5, 48.2, 252/50, 400 R, 402

[56] References Cited

U.S. PATENT DOCUMENTS

| | | | |
|---|---|---|---|
| 2,318,629 | 5/1943 | Prutton | 252/48.2 |
| 2,947,787 | 8/1960 | Flanagan | 252/48.2 |
| 3,494,963 | 2/1970 | Anderson | 252/47.5 |
| 3,505,225 | 4/1970 | Wheeler | 252/47.5 |
| 3,546,117 | 12/1970 | Anderson | 252/47.5 |
| 3,634,238 | 1/1972 | Bridger | 252/26 |

*Primary Examiner*—Irving Vaughn
*Attorney, Agent, or Firm*—Paul H. Ginsberg

[57] ABSTRACT

This invention is directed to a synergistic antioxidant system for use in oils comprising a phenylated naphthylamine, a sulfoxide compound, and, optionally, an oligodynamic amount of copper.

15 Claims, No Drawings

ANTIOXIDANT STABILIZED LUBRICATING OILS

The invention relates to improved lubricating oils having incorporated therein a novel stabilizer system comprising a phenylated naphthylamine compound, a sulfoxide compound and, preferably, copper or copper compounds, which system imparts to the oil a totally unexpected high degree of resistance with respect to oxidative breakdown.

The prior art discloses the stabilization of lubricating oils using various amines including p-phenylenediamine, diphenylamine, and naphthylamine with various sulfur containing compounds, but not sulfoxides. Furthermore, sulfoxides containing at least one aryl group directly attached to the sulfoxide linkage have not been shown. Amines in general have been used previously with either sulfides or metals but not with both. Heretofore, thus, there has been no recognition of the use of amines along with a sulfoxide compound and, optionally, an oligodynamic amount of copper or a copper compound, which provides unexpectedly improved results in stabilizing synthetic hydrocarbon oils, mineral oils of low unsaturation, and ester based oils.

Thus, one object of this invention is to provide a novel antioxidant system for use in lubricating oils.

Another object of this invention is to produce a lubricating oil for use at high temperatures. For example, lubricating oils employed in internal combustion engines and the like must be resistant to high temperature oxidative degradation.

It is a further object of this invention to produce a lubricating oil which, after aging, exhibits little or no acid build-up, sludge formation, or increase in viscosity, and which, after aging, will cause little or no metal corrosion.

It has been discovered that a stabilizer system comprising certain nitrogen-containing compounds, certain sulfoxide compounds, and, optionally, copper or copper compounds in admixture with the oil produces a lubrication product with unexpectedly far superior oxidation resistance compared with commercially available oils presently on the market.

The specific nitrogen-containing compounds used herein are the phenylated naphthylamines and their derivatives. These compounds are represented by the following formulae:

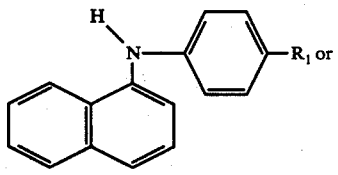

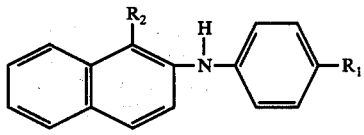

where $R_1$ and $R_2$ may be hydrogen, alkyl with 1 to 12 carbon atoms, aryl with 6 to 20 carbon atoms, or aralkyl or alkaryl with 7 to 20 carbon atoms. Some of these phenylated naphthylamines are described in U.S. Pat. No. 3,505,225, incorporated herein by reference. Preferably $R_1$ is hydrogen; tertiary pentyl; 1,1',3,3'-tetramethyl butyl; 1,1',3,3',5,5'-hexamethyl hexyl; alpha,alpha-dimethyl benzyl; triphenyl methyl; and $R_2$ is hydrogen; alpha, alpha-dimethyl benzyl; alphamethyl benzhydryl; triphenylmethyl; or alpha, alpha, p-trimethyl benzyl. Particularly useful are phenyl-alpha-naphthylamine, N-(4-alpha, alpha-dimethylbenzylphenyl)-alpha-naphthylamine, p-octylphenylalpha-naphthylamine, and phenyl-beta-naphthylamine. Also, the oxidized forms of these phenylated naphthylamines may be used.

The sulfoxide compounds to be used in accordance with the present invention are compounds soluble in the oil and having at least one aryl group attached to the sulfoxide radical. The other group attached to the sulfoxide radical may be either an aryl group or an alkyl group which does not have any beta-hydrogen atoms. Preferably, this other group is phenyl, substituted phenyl, naphthyl, or methyl. The substituents on the phenyl group may be halogen, alkanoyloxy, nitro, nitrile, alkyl, alkoxy, derivatives of carboxy groups (salts, esters, amides, hydrazides, etc.), amino, aryl, aryloxy, keto, or aldehydo.

The first aryl group may likewise be phenyl, a substituted phenyl, or a naphthyl group. The substituents on the phenyl group may be the same as above.

In addition to the phenylated naphthylamine and the sulfoxide, the antioxidant composition further may optionally include an oligodynamic amount of copper or a copper salt.

The copper may be added to the oil in any of several ways with the requirement that less than about 25 ppm, and preferably from 0.01 ppm to 5 ppm, of the copper be present to synergistically interact with the other components. It may be added to the oil in the form of a compatible soluble salt, preferably an organic salt due to a greater solubility in the oil. Alternatively, a piece of copper may be placed into the oil so that the oil is in contact with it. Thirdly, the copper may be introduced by being present in the engine or equipment in which the oil is used, i.e., the copper may be provided by contact of the oil with the metallic surfaces of the engine.

When the copper is added as a salt to the oil, the preferable salts to be used include naphthenates, stearates, acetylacetonates, octoates, decanoates, and other such long chain radicals.

The synthetic hydrocarbon oils to which the antioxidant system is added are those produced from alpha-olefins of $C_3$ to $C_{14}$ such as propene, butene, pentene, hexene, heptene, octene, nonene, decene, undecene, dodecene, tridecene, and tetradecene, which are oligomerized to produce a lubricating oil. Normally, the synthetic hydrocarbon oils usable herein are those having average molecular weights essentially between about 280 and 2,000, preferably between 350 and 1,500. The synthetic hydrocarbon oil must be of low unsaturation since it has been determined that there is a substantially direct relationship between the moles of unsaturation (C=C) and the effectiveness of the antioxidant system. Thus, the synthetic oil should have less than about 0.25 mole of unsaturation per 1,000 gm. of oil, preferably less than 0.15, and most preferably less than 0.05.

The mineral oils for which the present antioxidant system exhibits the synergistic results are hydrocarbon-based mineral oils which are substantially acid-free and which possess less than about 0.15 moles of unsaturation per 1,000 gm. of oil, preferably less than 0.1, and most preferably less than 0.05. The difference in the required levels of unsaturation between synthetic hydrocarbon oils and mineral oils is due to the inherently greater instability of the mineral oils.

The ester oils for which the present antioxidant system is suitable are synthetic lubricants based upon one or more organic carboxylic acid esters intended for use at an operating temperature at or above about 400° F. Examples of such oils include those based on a diester of a dibasic acid and a monohydric alcohol, for instance, dioctyl sebacate or dinonyl adipate; on a triester of trimethylolpropane and a monobasic acid or mixture of monobasic acids, for instance, trimethylolpropane tripelargonate or trimethylolpropane tricaprilate; or on a tetraester of pentaerythritol and a monobasic acid or mixture of monobasic acids, for instance, pentaerythritol tetracaprilate; or on complex esters derived from monobasic acids, dibasic acids and polyhydric alcohols; or on mixtures thereof.

The components of the antioxidant system, which may be added to the oil in any order, are used in the following amounts. The phenylated naphthylamine is used in amounts varying from about 0.15 to 3.0 parts by weight per 100 parts by weight of the oil, preferably 0.2 to 1.25 parts, and most preferably 0.3 to 0.6 parts. More than 1.25 parts of the amine are employed generally only when the oil is to be used under severe conditions, e.g., temperatures over 425° F., and usually only in ester oils.

The weight ratio of sulfoxide used to amine used ranges from 1/10 to 1/1 (ratios greater than 1/1 may be used but the additional amount of sulfoxide does not appear to be beneficial). For example, if 0.5 parts of phenylated naphthylamine are used, from 0.05 to 0.5 parts of sulfoxide are used.

Less than about 25 parts by weight of copper per million parts by weight of oil of copper should be present in the oil. Preferably, the amount is from 0.01 to 5 parts by weight of copper per million parts by weight of oil.

The components of the antioxidant system may also be pre-blended and the resulting mixture added to the oil. This pre-blended mixture contains from 1 to 10 parts by weight of phenylated naphthylamine per part of sulfoxide, and optionally contains an amount of copper that would result in a ratio of less than 25 parts by weight of copper per million parts by weight of oil when the antioxidant system is added to the oil, preferably from 0.01 to 5 parts by weight of copper per million parts by weight of oil of copper.

The criteria used herein to evaluate the effectiveness of an antioxidant for lubricating oils relate to (1) the amount of sludge produced; (2) the change in viscosity; (3) the change in neutralization number; and (4) the weight change of the test metals. After the oil sample containing the improved antioxidant system has been aged for 72 hours at 370° F., ideally there should be (1) no sludge formed, (2) no change from the initial viscosity, (3) no change in the neutralization number and (4) no weight change in the metals. The closer an oil comes to these ideal standards the more commercially acceptable the lubricating oil will be.

The following examples illustrate the invention. In these examples, "N.N." means neutralization number, as determined using ASTM test procedure D974-55T, and "%ΔV 100" means percent change in Saybolt viscosity at 100° F., wherein the Saybolt viscosity at 100° F. is determined using ASTM test procedure D445-53T. In all examples, the neutralization number of the unaged oil was essentially zero.

EXAMPLE I

This example shows the outstanding synergistic effect of using the stabilizer system of the present invention to protect a low-unsaturation synthetic hydrocarbon oil against oxidative degradation. The oil used was a polyoctene-based oil having 0.20 mole of unsaturation per 1,000 grams of oil and an average molecular weight of about 600.

Various samples were prepared in order to evaluate the effectiveness of the stabilizer system. Sample A was prepared by adding phenyl-alpha-naphthylamine and diphenylsulfoxide in the amounts set forth in Table I to 100 grams (about 125 ml) of the polyoctene-based oil and heating to about 100° C. in order to facilitate the dissolution of the additives. The copper metal was added in the form of a metal washer, as described below. Other samples contained the amine, diphenyl sulfide or diphenyl sulfone, and copper metal. The amounts used in each case are set forth in Table I.

Each of the samples was tested according to the following test procedure: A 100 ml sample having the compositions set forth in Table I was poured into a pyrex glass test cell and aged by inserting one end of a glass air delivery tube into the test cell while the remaining 25 ml portions of each original oil sample were set aside and analyzed for neutralization number and Saybolt viscosity at 100° F. Around this tube immersed in the oil were placed from zero to four washers of various metals (Mg, Cu, Ag, and Fe). Multiple washers were separated from each other by glass spacers. These washers remained in the oil during the aging process and served to indicate the extent of metal corrosion caused by the aging oil. The test cell was fitted with a reflux condenser, and the entire assembly was placed in a constant temperature aluminum block. Air was flowed through the oil at the rate of 5 liters per hour while the assembly was held at a temperature of 370° F. These aging conditions were maintained for 72 hours, after which the oil was filtered hot and the sludge which had formed was collected and measured. The filtered oil was analyzed to determine changes in neutralization number and Saybolt viscosity at 100° F.

The metal washers, which had been weighed initially, were carefully washed and reweighed to determine the weight change.

The data in Table I show that when a sulfoxide, such as diphenyl sulfoxide, and a phenylated naphthylamine, such as phenyl-alpha-naphthylamine, and copper metal are added to a synthetic hydrocarbon oil, the properties of the aged oil are excellent: there is very little change in the viscosity or neutralization number, very little sludge formation, and essentially no weight change in the metals.

In contrast, when diphenyl sulfide or diphenyl sulfone is used with the amine and copper, the oil is totally unprotected against oxidative degradations as shown by its inability to be filtered because of excessive sludge formation and viscosity increase.

Table I

| | A | B | C |
|---|---|---|---|
| Oil[1] | 100 | 100 | 100 |
| Sulfur Compound (g) | 0.25[2] | 0.25[3] | 0.25[4] |
| PAN[5] (g) | 0.50 | 0.50 | 0.50 |
| Cu (ppm) | 1–5[6] | 1–5[6] | 1–5[6] |
| % Δν100 | 3.5 | Failed | Failed |

Table I-continued

| | | | |
|---|---|---|---|
| | | test[7] | test[7] |
| N.N. | 0.31 | Failed test[7] | Failed test[7] |
| Sludge (mg) | 5.3 | Failed test[7] | Failed test[7] |
| Weight Change of Washers (g) | | | |
| Magnesium | 0 | — | — |
| Iron | +.0001 | — | — |
| Copper | −.0002 | — | — |
| Silver | 0 | — | — |

[1]Polyoctene-based oil
[2]Diphenyl sulfoxide
[3]Diphenyl sulfide
[4]Diphenyl sulfone
[5]Phenyl-alpha-naphthylamine
[6]Estimated; from washer
[7]Would not filter

EXAMPLE II

This example demonstrates the synergism between the amine and the sulfoxide compounds. The procedure of Example I was repeated using the compositions listed in Table II, below. Sample D contained the amine without the sulfoxide; sample E contained the sulfoxide without the amine and sample F contained both the amine and the sulfoxide.

The results show that if the amine or sulfoxide is used individually, even with copper, essentially no protection is afforded the oil, whereas the use of the amine and the sulfoxide together, according to the present invention, provides substantial protection to the oil.

TABLE II

| | D | E | F |
|---|---|---|---|
| Oil[1] (g) | 100 | 100 | 100 |
| Diphenyl Sulfoxide (g) | — | 0.25 | 0.25 |
| PAN[2] | 0.5 | — | 0.5 |
| Cu (ppm) | 1-5[3] | 1-5[3] | 1-5[3] |
| % Δ ν 100 | 22 | 25.5 | 3.5 |
| N.N. | 3.46 | 6.1 | 0.31 |
| Sludge (mg) | 1320 | 3011 | 5.3 |
| Weight Change of Washers (g) | | | |
| Mg | −.1511 | −.0208 | 0 |
| Fe | +.0002 | +.0006 | +.0001 |
| Cu | −.0014 | −.0075 | −.0002 |
| Ag | +.0004 | +.0001 | 0 |

[1]Polyoctene-based oil
[2]Phenyl-alpha-naphthylamine
[3]Estimated; from washer

EXAMPLE III

This example shows the protection provided by the present invention in synthetic hydrocarbon oils having different degrees of unsaturation.

The procedure of Example I was used to prepare and test samples containing diphenyl sulfoxide and phenyl-alpha-naphthylamine (0.25 and 0.50 parts/100 parts of polyoctene oil, respectively) and a copper washer.

The date in Table III below, show that the present invention provides greater protection to synthetic hydrocarbon oils which are more saturated.

TABLE III

| | G | H | I | J |
|---|---|---|---|---|
| Unsaturation (Moles of C=C per 1000 g oil) | 0.02 | 0.10 | 0.18 | 0.34 |
| Sludge (mg) | 5.3 | 154.8 | 401.5 | Failed test[1] |
| % Δ ν 100 | +3.5 | +23.4 | +22.2 | Failed test[1] |
| N.N. | 0.31 | 0.25 | 0.16 | Failed test[1] |
| Weight Change of Washers (g) | | | | |
| Mg | 0 | −.0335 | −.0844 | dissolved (−.3024) |
| Fe | +.0001 | −.0002 | 0 | 0 |
| Cu | −.0002 | −.0025 | −.0020 | −.0038 |
| Ag | 0 | 0 | +.0002 | +.0003 |

[1]Would not filter

EXAMPLE IV

This example shows the protection provided by the present invention to mineral and ester oils.

The mineral oil used was a highly refined white mineral oil identified as ERVOL from Witco Chemical with a Saybolt viscosity of 137.7 SUS at 100° F. The ester oil used was trimethylol propane triheptanoate.

The samples were prepared and tested in accordance with the procedure of Example I.

The results of the tests, in Table IV, show that both oils were protected when the synergistic antioxidant system of this invention was used, whereas the unprotected mineral oil (without the antioxidant system) could not even be filtered (sample K).

TABLE IV

| | K | L | M |
|---|---|---|---|
| Oil type | Mineral | Mineral | Ester |
| Unsaturation level of oil (moles/1000 gms) | 0.03 | 0.03 | 0 |
| PAN[1,2] | 0 | 0.50 | 0.50 |
| Diphenyl Sulfoxide[2] | 0 | 0.25 | 0.25 |
| % Δν 100 | Failed test[3] | +27.8 | +1.8 |
| N.N. | Failed test[3] | 0.45 | 0.24 |
| Sludge (mg) | Failed test[3] | 83 | 12.6 |
| Weight Change (g) | | | |
| Mg | dissolved | −.0207 | 0 |
| Fe | −.0019 | −.0002 | 0 |
| Cu | −.0063 | −.0022 | −.0010 |
| Ag | −.0001 | 0 | +.0002 |

[1]Phenyl-alpha-naphthylamine
[2]Parts per hundred parts of oil
[3]Would not filter

EXAMPLE V

This example shows the protection offered by the present invention when various other phenylated naphthylamines are used. The oil was the same as in Example I, and the samples were prepared and tested in accordance with the procedure of Example I. The results are shown below in Table V.

TABLE V

| | N | O |
|---|---|---|
| Diphenyl Sulfoxide (g) | 0.25 | 0.25 |
| Amine (g) | 0.75[1] | 0.5[2] |
| % Δ ν 100 | +14.5 | +20.3 |
| N.N. | 0.20 | 0.22 |
| Sludge (mg) | 34.4 | 175.5 |
| Weight Change (g) | | |
| Mg | +.0057 | −.0029 |
| Fe | −.0003 | −.0002 |
| Cu | −.0034 | −.0019 |
| Ag | 0 | +.0002 |

[1]LO-6, a commercially available p-octyl phenyl-alpha-naphthylamine, marketed by Ciba-Geigy Chemical Co. and described in U.S. Patent 3,414,618
[2]Phenyl-beta-naphthylamine, a commercially available antioxidant marketed under the trade name "PBNA" by Uniroyal, Inc.

EXAMPLE VI

This example shows the use of various other sulfoxides, both inside and outside the scope of the present invention.

The samples were prepared and tested in accordance with the procedure of Example I. In all cases, 0.25g of the sulfoxide, 0.5 g of PAN, and 1 to 5 ppm of copper were used.

TABLE VI

| Sample | Sulfoxide | Sludge (mg) | N.N. | %→ν 100 |
|---|---|---|---|---|
| P | Diphenyl sulfoxide | 5.3 | 0.31 | +1.5 |
| Q | 4,4'-Dichlorodiphenyl sulfoxide | 20.8 | 0.77 | +8.3 |
| R | Dibenzothiophene oxide | 20.6 | 3.92 | +19.4 |
| S | Phenyl methyl sulfoxide | 160.2 | 2.99 | +12.2 |
| T | p-Decanoyloxyphenyl methyl sulfoxide | 12.2 | 0.28 | +3.5 |
| U | Naphthyl methyl sulfoxide | 38.6 | 2.34 | +11.4 |
| V[1] | Phenoxathiin-S-oxide (insoluble) | Failed test[2] | Failed test[2] | Failed test[2] |
| W[1] | p-tert-butylphenyl ethyl sulfoxide | 915.5 | 2.05 | +11.1 |
| X[1] | Phenyl beta-hydroxy-beta-cyano-ethyl sulfoxide | Failed test[2] | Failed test[2] | Failed test[2] |
| Y[1] | Dilauryl beta, beta'-sulfonyldipropionate | 176.4 | 4.1 | +15.5 |
| Z[1] | Dibenzyl sulfoxide | 339.0 | 2.6 | +12.2 |
| AA[1] | Didodecyl sulfoxide | 195.1 | 2.84 | +13.4 |

[1]Not within the scope of the invention
[2]Would not filter

The results in Table VI, above, show that sulfoxides having at least one aromatic group, but no alkyl group with a beta hydrogen, directly attached to the sulfoxide (P, Q, R, S, T, U) are most effective. Such sulfoxides are within the scope of the present invention.

The sulfoxides used in Samples V, W, X, Y, Z and AA are outside the scope of the present invention for the following reasons: the sulfoxide of Sample V was insoluble in the oil; the sulfoxides of W, X, Y and AA all contain hydrogen atoms on the alkyl group in the beta position to the sulfoxide; and the sulfoxide of Z does not have an aryl group attached to the sulfoxide.

EXAMPLE VII

This example shows the effect of copper in the antioxidant system of the present invention. The samples were prepared and tested in accordance with the procedure of Example I, with the exception that the copper was added in the form of copper naphthenate. All of the samples contained 0.25 parts diphenyl sulfoxide and 0.50 parts phenyl-alpha-naphthylamine per 100 parts of oil. None of the samples contained any metal washers.

TABLE VII

| Sample | Cu (ppm) | N.N. | % Δν 100 | Sludge (mg) |
|---|---|---|---|---|
| BB | 0 | 4.5 | 55.5 | 40.7 |
| CC | 1 | 3.1 | 17.5 | 31.9 |
| DD | 5 | 5.1 | 26.6 | 13.7 |
| EE | 10 | 5.5 | 21.5 | 148.6 |
| FF | 25 | 7.2 | 30.6 | 453.0 |

Table VII, above, shows that the use of copper in small amounts, i.e., 5 ppm or less, is most effective. At higher concentrations of copper, e.g., over 25 ppm, sludge formation becomes excessive.

What is claimed is:

1. An antioxidant stabilized oil comprising:

(a) an oil selected from the group consisting of (1) synthetic hydrocarbon oils produced from alpha-olefins having 3 to 14 carbon atoms, and having an average molecular weight between about 280 and 2000, and having less than about 0.25 moles of unsaturation per 1000 grams of oil, (2) hydrocarbon-based mineral oils which are substantially acid-free and which possess less than 0.15 moles of unsaturation per 1000 grams of oil, and (3) ester oils;

(b) a phenylated naphthylamine of the formula

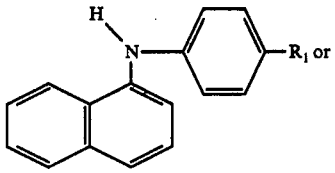

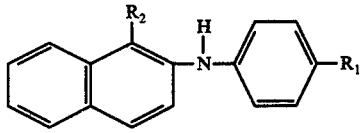

wherein $R_1$ and $R_2$ are each independently selected from the group consisting of hydrogen, alkyls having 1 to 12 carbon atoms, aryls having 6 to 20 carbon atoms, and aralkyls and alkaryls having 7 to 20 carbon atoms, said phenylated naphthylamine being present in an amount equal to about $15 \times 10^2$ to $30 \times 10^3$ parts by weight per million parts by weight of oil; and (c) an oil-soluble diaryl sulfoxide or arylalkyl sulfoxide wherein the alkyl group is free of hydrogen atoms in the beta position to the sulfoxide group, the weight ratio of sulfoxide in the oil to phenylated naphthylamine in the oil being from 1/10 to 1/1.

2. The antioxidant stabilized oil of claim 1, wherein there are first and second groups attached to the sulfoxide radical, wherein said first group is phenyl, substituted phenyl, or naphthyl, and said second group is phenyl, substituted phenyl, naphthyl, or methyl, and the substituents on the substituted phenyl groups are independently selected from the group consisting of halogen, alkanoyloxy, nitro, nitrile, alkyl, alkoxy, a derivative of a carboxy group, amino, aryl, aryloxy, keto, or aldehydo.

3. The stabilized oil of claim 1, further comprising up to about 25 parts of copper by weight per million parts by weight of oil.

4. The stabilized oil of claim 1 wherein the oil is a synthetic hydrocarbon oil.

5. The stabilized oil of claim 1 wherein the phenylated naphthylamine is phenyl-alpha-naphthylamine, N-(4-alpha,alpha-dimethylbenzyl phenyl)-alpha-naphthylamine, p-octyl-phenyl-alpha-naphthylamine, or phenyl-beta-naphthylamine.

6. The stabilized oil of claim 1 wherein the sulfoxide compound is diphenyl sulfoxide, 4,4'-dichlorodiphenyl sulfoxide, dibenzothiophene oxide, phenyl methyl sulfoxide, p-decanoyloxyphenyl methyl sulfoxide, or naphthyl methyl sulfoxide.

7. The stabilized oil of claim 1 wherein the sulfoxide compound is diphenyl sulfoxide.

8. An antioxidant system for use in an oil comprising:

(a) a phenylated naphthylamine of the formula

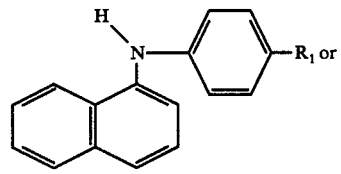

-continued

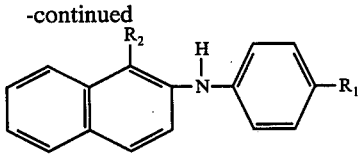

wherein $R_1$ and $R_2$ are each independently selected from the group consisting of hydrogen, alkyls having 1 to 12 carbon atoms, aryls having 6 to 20 carbon atoms, and aralkyls and alkaryls having 7 to 20 carbon atoms; and (b) an oil-soluble diaryl sulfoxide or arylalkyl sulfoxide wherein the alkyl group is free of hydrogen atoms in the beta position to the sulfoxide group; the weight ratio of sulfoxide to phenylated naphthylamine being from 1/10 to 1/1.

9. The antioxidant system of claim 8, wherein there are first and second groups attached to the sulfoxide radical, wherein said first group is phenyl, substituted phenyl, or naphthyl, and said second group is phenyl, substituted phenyl, naphthyl or methyl, and the substitnents on the substituted phenyl groups are independently selected from the group consisting of halogen, alkanoyloxy, nitro, nitrile, alkyl, alkoxy, a derivative of a carboxy group, amino, aryl, aryloxy, keto, or aldehydo.

10. The antioxidant system of claim 8, wherein there are $15 \times 10^2$ to $30 \times 10^3$ parts by weight of phenylated naphthylamine and up to 25 parts by weight of copper.

11. The antioxidant system of claim 10, wherein there are 0.01 to 5 parts by weight of copper.

12. The antioxidant system of claim 8 wherein the phenylated naphthylamine is phenyl-alpha-naphthylamine, N-(4-alpha,alpha-dimethylbenzyl phenyl)-alpha-naphthylamine, p-octyl-phenyl-alpha-naphthylamine, or phenyl-beta-naphthylamine.

13. The antioxidant system of claim 8 wherein the sulfoxide compound is diphenyl sulfoxide, 4,4'-dichlorodiphenyl sulfoxide, dibenzothiophene oxide, phenyl methyl sulfoxide, p-decanoyloxyphenyl methyl sulfoxide, or naphthyl methyl sulfoxide.

14. The antioxidant system of claim 8 wherein the sulfoxide compound is diphenyl sulfoxide.

15. The antioxidant system of claim 8 wherein (a) is phenyl-alpha-naphthylamine and (b) is diphenyl sulfoxide.

* * * * *